US005904406A

United States Patent [19]

Stewart

[11] Patent Number: 5,904,406

[45] Date of Patent: May 18, 1999

[54] HEADREST

[76] Inventor: John G. Stewart, 690 Crosby Pl., San Leandro, Calif. 94579

[21] Appl. No.: 08/991,978

[22] Filed: Dec. 17, 1997

Related U.S. Application Data

[60] Provisional application No. 60/034,031, Dec. 23, 1996.

[51] Int. Cl.[6] ..... A47C 7/38

[52] U.S. Cl. ..... 297/397; 297/220; 5/490

[58] Field of Search ..... 297/397, 391, 297/227, 220, DIG. 6, 230.13; 5/490, 636, 417, 420

[56] References Cited

U.S. PATENT DOCUMENTS

| | | | |
|---|---|---|---|
| 2,013,481 | 9/1935 | Stonihell | 297/230.13 |
| 2,983,310 | 5/1961 | Warlick et al. . | |
| 3,046,057 | 7/1962 | Smetko . | |
| 3,884,495 | 5/1975 | Petock | 248/345.1 |
| 4,109,887 | 8/1978 | Wakeland . | |
| 4,165,125 | 8/1979 | Owen . | |
| 4,554,039 | 11/1985 | James . | |
| 4,773,707 | 9/1988 | Vadala . | |
| 5,048,892 | 9/1991 | Ledbetter . | |
| 5,240,330 | 8/1993 | Thompson | 297/397 |
| 5,281,000 | 1/1994 | Ackley . | |
| 5,445,433 | 8/1995 | Avihod | 297/DIG. 6 |
| 5,700,053 | 12/1997 | Downing | 297/227 |

*Primary Examiner*—Peter M. Cuomo
*Assistant Examiner*—Anthony D. Barfield
*Attorney, Agent, or Firm*—Douglas E. White

[57] ABSTRACT

A foam-core fabric-covered headrest snaps in place over the top tube of the frame of any of a wide variety of lawn or beach furniture. The core is a resilient foam cylinder into which is cut or molded a radially directed longitudinal slit leading to a cylindrical axial channel. A cylindrically looped one-piece fabric shell covers the side surface of the foam core—slit, channel and all. Preferably, a tether is provided with which to secure the device to the chair frame. The tether prevents accidental dislodging of the device while the chair is being transported. It also tends to discourage theft and other forms of inadvertent loss.

7 Claims, 2 Drawing Sheets

FIG. 1
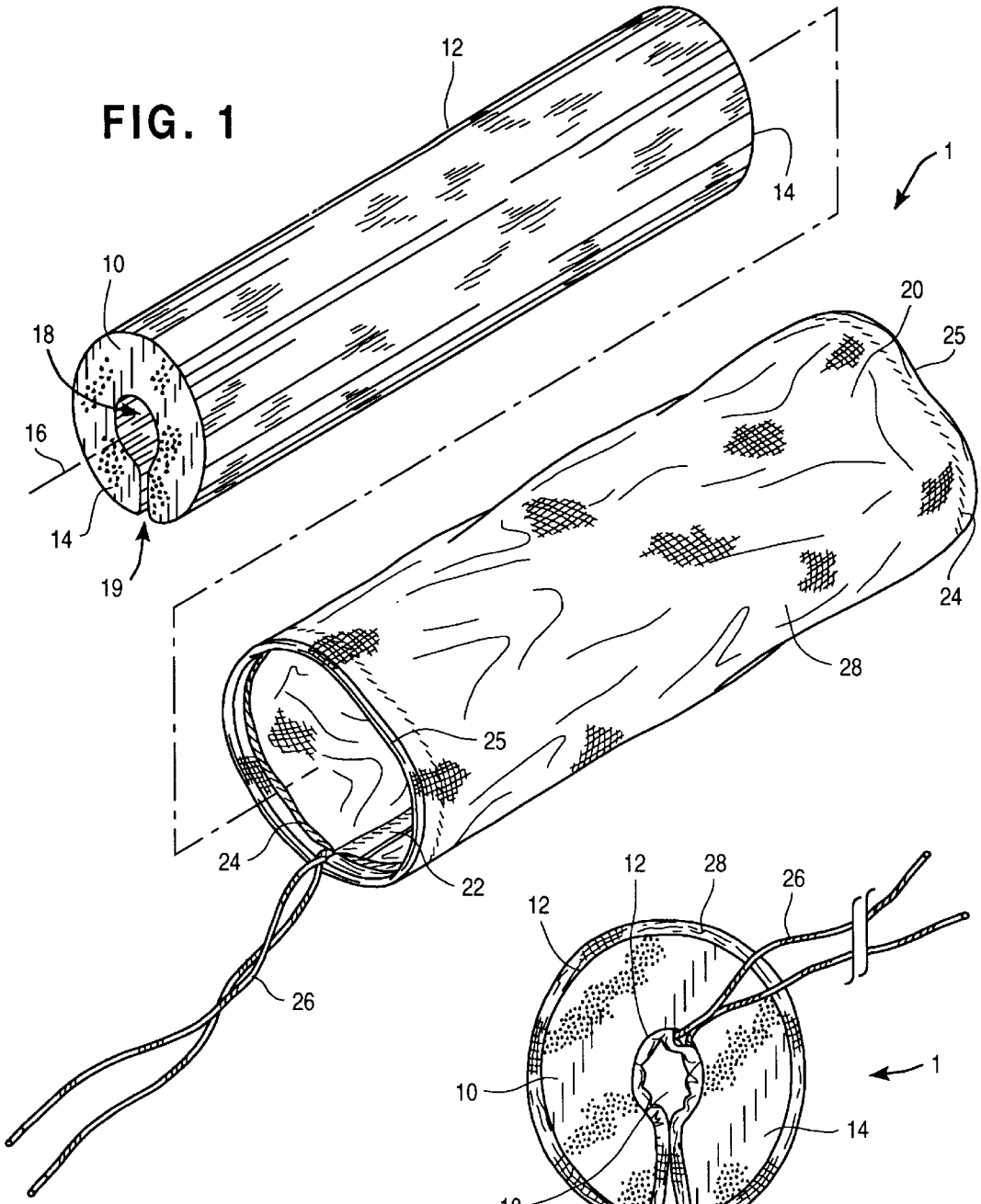
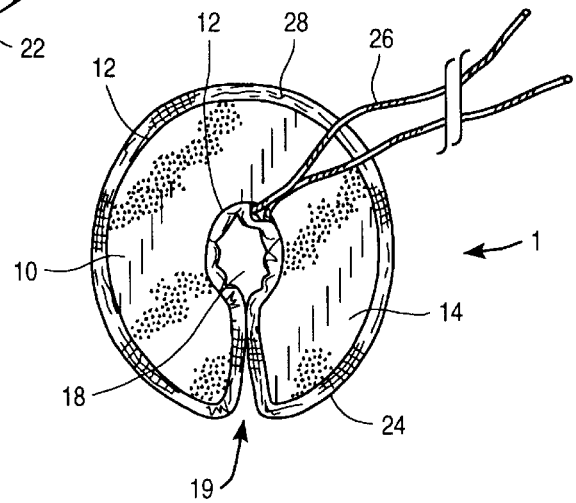
FIG. 2

HEADREST

CROSS REFERENCE TO RELATED APPLICATIONS

This application claims the benefit of U.S. Provisional application No. 60/034,031 filed Dec. 23, 1996.

FEDERALLY SPONSORED RESEARCH OR DEVELOPMENT

Not applicable.

FIELD OF THE INVENTION

This invention relates to collapsible lawn and beach furniture, more particularly to a foam headrest that clamps itself onto a chair or the like.

BACKGROUND OF THE INVENTION

It is uncomfortable to sit in tube frame lawn chairs for long periods, because typically there is no headrest provided. If one leans one's head back against the horizontal top tube of the frame of the chair this soon becomes painful. The frame normally is hard metal and is so relatively thin that a hard edge (albeit a rounded one) contacts the skull or neck at an uncomfortably focused pressure point or line. While the laced web of the chair does cover the top tube, typically it is very thin, and is comfortably resilient only in those areas where it is suspended off of the frame.

Prior developments in this field may be generally illustrated by reference to the following information disclosure statement:

U.S. PATENT DOCUMENTS

| U.S. Pat. No. | Patentee | Issue Date |
|---|---|---|
| 4,109,887 | W. Wakeland | Aug. 29, 1978 |
| 4,554,039 | M. James | Nov. 19, 1985 |
| 4,773,707 | P. Vadala | Sep. 27, 1988 |
| 3,046,057 | F. Smetko | Jul. 24, 1962 |
| 5,048,892 | M. Ledbetter | Sep. 17, 1991 |
| 5,281,000 | R. Ackley | Jan. 25, 1994 |
| 2,983,310 | W. Warlick et al. | May 9, 1961 |
| 4,165,125 | H. Owen | Aug. 21, 1979 |

U.S. Pat. No. 5,048,892 teaches attachable cushions—for lawn chairs. Foam tube members are shown therein, as well as inflatable ones. FIG. 2 shows foam members snapped on the frame tubes of the lawn chair. One is shown as a foot rest and the patent also speaks of S using them for the head. Wide, open gaps for entry of frame members allow easy installation of the devices, but may fail to provide them with secure attachment.

U.S. Pat. Nos. 4,109,887 and 4,554,039 teach C-shaped cushions for bed rails. Patents 3,046,057, 4,165,125, and 4,773,707 teach headrest attachments for chairs that fit over the top of a chair and are made of foam. The rest of the patents are representative of what was found in a search of the art.

Of course, pillows become soiled over time, which is why pillowcases have been developed for conventional lozenge-shaped pillows. Because of the particular shape of a snap-on tube pillow, the conventional pillowcase is unsuitable. While a number of patents disclose foam tubes covered by fabric, none disclose a method of using a tube of fabric which does not need to be glued in place on the pillow, and, hence, remains interchangeable. It is especially important to be able to change the covers of such pillows, which will be used for sunbathing and other outdoor activities—wherein body oils and environmental dirt will quickly accumulate.

Another reason for interchangeable covers on pillows, which currently is missing from the snap-on pillow art, is that interchangeability allows for the application of individual taste and sensibility in the selection of a cover, not to mention the ability to alter the appearance of the cover to match the occasion. For example, it would be convenient if a user could have two or more covers for a single pillow—one having the logo of the user's favorite baseball team, one with a football logo, and so on. As is common practice in the T-shirt industry, covers could bear travel, political, humorous and other types of messages, as well as advertising material.

Furthermore, the art does not teach a tether for keeping a snap-on headrest in place—for example, while the chair is being transported. Such a tether would also render the device more resistant to petty theft or loss.

SUMMARY OF THE INVENTION

The present invention is an add-on, after-market lawn chair accessory, namely, a foam-core fabric-covered headrest that slips in place over the top tube of the frame of any of a wide variety of lawn or beach chairs and recliners.

The core is a foam cylinder into which is cut a generally planar, radially directed, longitudinal slit that leads to a cylindrical axial hollow or channel.

A new one piece, open-ended, cylindrically looped fabric shell forms a cover for the side surface of the foam core—slit, channel and all. The cover easily slips on and off of the core for cleaning or for the substitution of an alternate cover.

Preferably, a tether in the form of a string, line, ribbon or cord is provided with which to tie the device to the chair frame. The tether prevents accidental dislodging of the device while the chair is being transported. It also tends to discourage theft and other forms of unintentional loss.

FEATURES AND ADVANTAGES

It is therefore an object of the present invention to teach a novel headrest for tube frame lawn or beach chairs which has all, or nearly all, of the advantageous features of the prior art, and which, at the same time, overcomes most of the disadvantages presently associated therewith.

Accordingly, a feature of this invention is a foam core whose generally cylindrical shape provides comfortable cushioning to the head or neck of a user.

Another feature is a fabric shell forming a cover that may be removably attached to the core, which shell readily may be decorated with attractive patterns or indicia. The fabric of the shell is more comfortable to the user than uncovered foam which has the tendency to film up with perspiration or condensation. On other occasions, uncovered foam may stick to one's skin in an irritating fashion. The cover is easily removed, which allows covers of different colors and patterns to be substituted at will.

Yet another feature is a radially directed planar slit communicating with a longitudinally directed cylindrical hollow channel extending through the core of the headrest along the axis thereof. The top tube of the chair frame may pass through the slit in order to removably affix the headrest to the chair frame. Preferably, the gap formed by the slit is closed when the cover is on the headrest, but is forced open when the device is snapped in place over a chair frame tube.

Still yet another feature is a tether attached to the fabric shell which may be used to secure the headrest to the frame of the chair.

Another feature is an apparatus that is easy to use, attractive in appearance and suitable for mass production at relatively low cost.

Accordingly, an object of the invention is to disclose a headrest including: a foam core formed in the general shape of a first cylinder, the core having an outer side periphery and two opposed ends; a longitudinal axis of the core; a cylindrical axial channel formed along the longitudinal axis; a radially directed longitudinal slit leading to the axial channel; a single side surface continuously extending throughout the outer side periphery of the core, the longitudinal slit and the axial channel; and a fabric shell covering the single side surface.

Another object or feature is that the fabric shell is formed in the general shape of a hollow thin-walled second cylinder made of fabric affixed to itself along a longitudinal seam.

Yet another object is to disclose at least one tether attached to the fabric shell.

Still another is to disclose at least one circumferential seam of the shell in the vicinity of at least one end of the core, wherein the tether is looped through the circumferential seam.

Another optional feature is where the tether is able to slide within the circumferential seam.

A preferred feature is that the fabric shell is removable from the core.

As still other features, the second cylinder will have a larger radius than the first cylinder, the longitudinal slit may be generally planar, and the fabric shell may substantially fill the longitudinal slit.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and will not be limiting. For example, words such as "upwardly," "downwardly," "leftward," and "rightward" would refer to directions in the drawings to which reference is made unless otherwise stated. Similarly, words such as "inwardly" and "outwardly" would refer to directions toward and away from, respectively, the geometric center of a device or area and designated parts thereof References in the singular tense include the plural, and vice versa, unless otherwise noted.

BRIEF DESCRIPTION OF THE DRAWING

FIG. 1 is an exploded perspective view of a preferred headrest of this invention;

FIG. 2 is an end elevation of the headrest of FIG. 1; and

DRAWING REFERENCE NUMERALS

Figure 3:
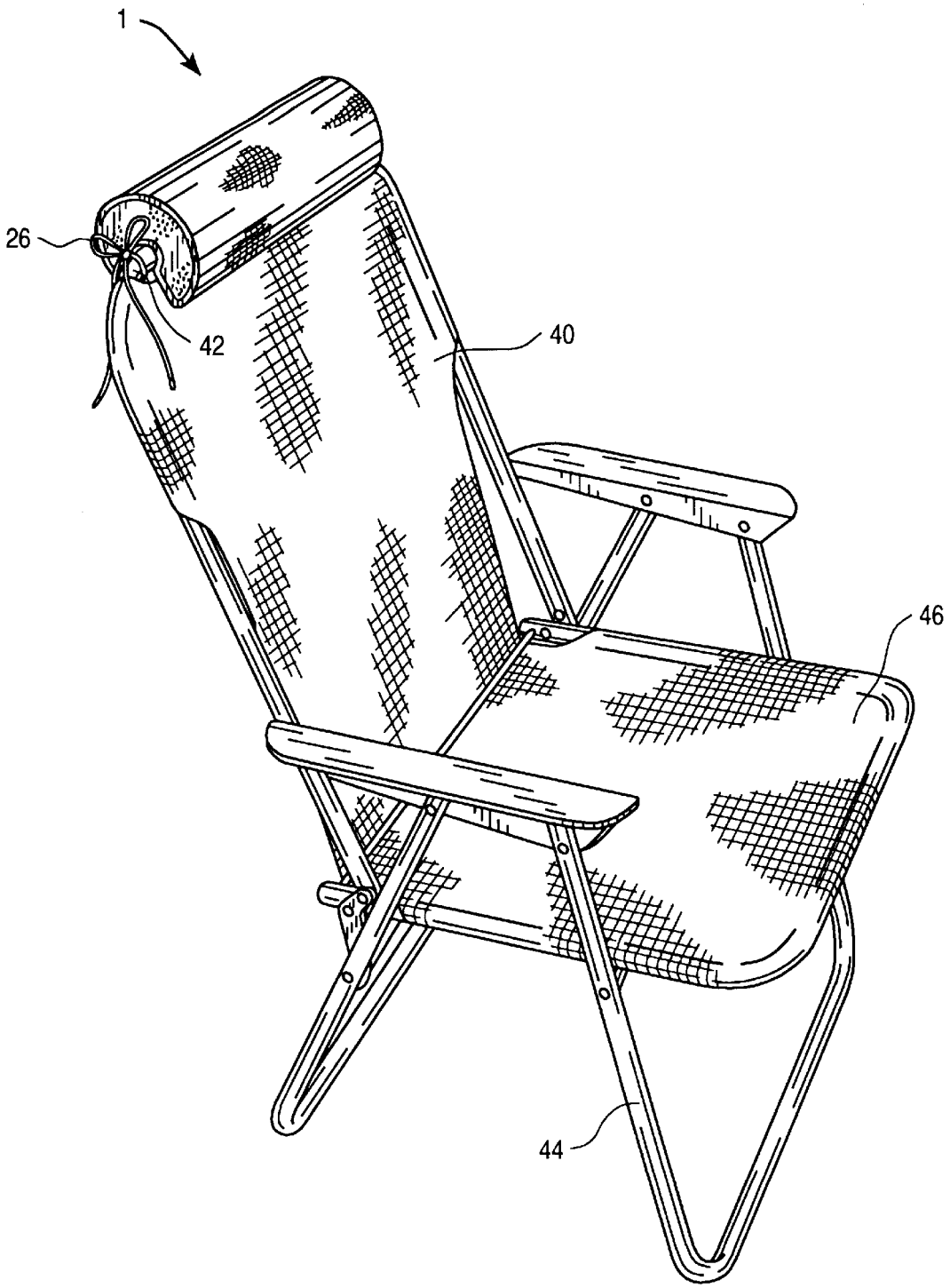
FIG. 3 is a perspective view of the headrest of FIG. 1 installed in the intended environment tube frame chair.

1 headrest
10 core
12 side surface
14 end
16 axis
18 axial channel
19 longitudinal slit
20 cover
22 longitudinal seam
24 circumferential seam
25 end
26 tether
28 fabric shell
40 chair
42 top tube
44 tube frame
46 laced web

DETAILED DESCRIPTION OF THE INVENTION

Referring to FIG. 1, there is illustrated therein a headrest 1 of this invention. The headrest 1 is comprised of a core 10 and a removable cover 20.

The core 10 is composed of expanded cell-foam polymer plastic or foam rubber. Preferably plastic foam of the closed-cell type is used, but open-cell foam may be employed. The core is cylindrical in shape, having two parallel ends 14 that are generally perpendicular to the axis 16 of the core 10.

A cylindrical hollow or channel 18 extends from end to end along the longitudinal axis 16 of the core 10. Communicating with the anal channel 18 is a radially directed longitudinal slit 19 that is generally planar in shape.

The cover 20 principally is comprised of a shell 28 composed of a single piece of fabric sewn in the shape of a loop (or thin-walled cylinder) by means of a single longitudinal seam 22. Two circumferential seams 24 at the open and opposed ends 25 of the fabric shell 28 dress said ends. One or more tethers 26 of string, line, ribbon, cord or the like, are provided, each looped through or against a circumferential seam 24 (only one such double-ended tether 26 being illustrated). The tethers 26 may be sewn fixedly in place at the ends and other points of the circumferential seams. Alternatively, each tether (or a sole tether) may be captured loosely (or sewn only at its midpoint) within the circumferential seam 24 so as to form a drawstring able to slide therein, with which to narrow the effective circumference of the shell end 25.

It is to be noted that a single side surface 12 of the core 10 extends not only throughout the outer side periphery thereof, but also continuously through the longitudinal slit 19, around the axial channel 18, and back out the longitudinal slit 19. This "side surface," as the term is used herein, does not include the surfaces of the two flat core ends 14 and 25. The continuous nature of the side surface 12 conveniently enables the cover 20 to be formed of a single piece of cylindrically sewn fabric, yet to cover all of the side surface 12 of the core 10, as best seen in FIG. 2. The main part of the fabric shell 28 covers the outer side periphery of the core 10, while a small part is tucked into the longitudinal slit 19—protecting the slit and the axial channel 18. Part of the fabric shell 28 also fills in the gap in the core 10 made by the slit 19 (i.e., it substantially fills or closes the slit). This aids in keeping the device firmly in place.

FIG. 3 illustrates the preferred environment of use of the headrest 1. A typical beach or lawn chair 40 has a tube frame 44 made of aluminum or other metal, or, in some cases, extruded or molded plastic. The tube frame 44 has an interlaced web 46 (typically formed of tubes or straps) stretched over it and sewn or stapled in place. The uppermost part of the tube frame 44 will be referred to as the top tube 42.

To use the headrest 1, one merely need direct the top tube 42 into the longitudinal slit 19, which temporarily extends open to receive it (the core 10 being resilient). Once the top tube 42 is in the slightly enlarged axial channel 18, the headrest 1 effectively is trapped on the chair 40 by compression. Thereafter, the tether 26 may be tied to the top tube 42 or other part of the chair 40, further to secure the headrest 1 thereon.

Once on the top tube 42, the headrest 1 is properly positioned to provide comfort to the head and neck of a user of the chair 40.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like.

For example, the invention may be used with other types of chairs, such as wooden rocking chairs and the like, with little or no modification of the shapes of the axial channel 18 and the longitudinal slit 19. The core 10 need not be completely cylindrical—it could have enlarged ridges at the ends to form fit the user's neck and still be said to be generally cylindrical—or, it might not be cylindrical at all. The tether 26 may incorporate snaps, hook and loop fasteners, or other securement means to eliminate the need to tie it to the chair with a knot. As yet another example, the core could be made of an inflatable film rather than foam.

Therefore, the above description and illustrations should not be construed as limiting the scope of the invention, which is defined by the appended claims.

What is claimed is:

1. A headrest including:

a core, the core having an outer side periphery and two opposed ends;

a longitudinal axis of the core;

an axial channel formed along the longitudinal axis;

a longitudinal slit leading from the outer side periphery to the axial channel;

a single side surface continuously extending throughout the outer side periphery of the core, the longitudinal slit and the axial channel;

a removable fabric shell covering the single side surface;

at least one tether attached to the fabric shell; and at least one circumferential seam of the shell in the vicinity of at least one end of the core, wherein the tether is looped through the circumferential seam.

2. The apparatus of claim 1 wherein:

the tether is able to slide within the circumferential seam.

3. The apparatus of claim 2 wherein:

the longitudinal slit is generally planar, forms two opposing walls, and forms a gap between the walls, the gap having a point of minimum gap width, and the fabric shell has a thickness at least equal to one half of the minimum gap width, so that the fabric shell substantially closes the longitudinal slit at the point of minimum gap width with two portions of the fabric shell, one portion being adjacent to each slit wall.

4. A headrest including:

a foam core formed in the general shape of a first cylinder, the core having an outer side periphery and two opposed ends;

a longitudinal axis of the core;

a cylindrical axial channel formed alone the longitudinal axis;

a radially directed longitudinal slit leading to the axial channel;

a single side surface continuously extending throughout the outer side periphery of the core, the longitudinal slit and the axial channel;

a fabric shell covering the single side surface, the fabric shell formed in the general shape of a hollow thin-walled second cylinder made of fabric affixed to itself along a longitudinal seam;

at least one tether attached to the fabric shell; and at least one circumferential seam of the shell in the vicinity of at least one end of the core, wherein the tether is looped through the circumferential seam.

5. The apparatus of claim 4 wherein:

the tether is able to slide within the circumferential seam.

6. The apparatus of claim 4 wherein:

the fabric shell is removable from the core.

7. The apparatus of claim 6 wherein:

the second cylinder has a larger radius than the first cylinder, the longitudinal slit is generally planar, and the fabric shell substantially fills the longitudinal slit.

* * * * *